US010636397B2

(12) United States Patent
Mackey et al.

(10) Patent No.: US 10,636,397 B2
(45) Date of Patent: Apr. 28, 2020

(54) STAND FOR A MUSICAL INSTRUMENT

(71) Applicant: The Australian National University, Acton, Australian Capital Territory (AU)

(72) Inventors: John Albert Mackey, Wamboin (AU); Stephen Murray Holgate, Murrumbateman (AU)

(73) Assignee: THE AUSTRALIAN NATIONAL UNIVERSITY, Acton, Australian Capital Territory (AU)

( * ) Notice: Subject to any disclaimer, the term of this patent is extended or adjusted under 35 U.S.C. 154(b) by 0 days.

(21) Appl. No.: 16/301,092

(22) PCT Filed: May 15, 2017

(86) PCT No.: PCT/AU2017/000106
§ 371 (c)(1),
(2) Date: Nov. 13, 2018

(87) PCT Pub. No.: WO2017/197431
PCT Pub. Date: Nov. 23, 2017

(65) Prior Publication Data

US 2019/0189098 A1 Jun. 20, 2019

(30) Foreign Application Priority Data

May 20, 2016 (AU) ..... 2016901906

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 5/00; G10D 13/08; G10D 13/026
See application file for complete search history.

(56) References Cited

U.S. PATENT DOCUMENTS 2,153,821 A 4/1939 Walberg
4,065,994 A 1/1978 Streit
(Continued)

FOREIGN PATENT DOCUMENTS

CN 2549567 Y 5/2003
DE 102010053212 A1 6/2012
KR 20100134327 A 12/2010

OTHER PUBLICATIONS

PCT Written Opinion for related application PCT/AU2017/000106 dated Jul. 17, 2017; 7 pp.
(Continued)

*Primary Examiner* — Robert W Horn
(74) *Attorney, Agent, or Firm* — Armstrong Teasdale LLP

(57) ABSTRACT

A stand for a musical instrument, the stand comprising: a base; an upright having an upper end and extending upwardly from the base to the upper end; a member comprising a first end portion and a second end portion, the member being mounted on the upper end of the upright between the first end portion and the second end portion; an attachment fitting mounted on the first end portion and configured to releasably attach the musical instrument; and a counterweight mounted on the second end portion for balancing the weight of the musical instrument.

24 Claims, 21 Drawing Sheets

(56) References Cited

U.S. PATENT DOCUMENTS 4,572,050 A * 2/1986 Werner ..... G10G 5/00 84/385 A
4,987,817 A * 1/1991 Diaz ..... G10D 13/06 84/421
5,449,138 A * 9/1995 Ciancio ..... F16M 11/10 248/123.2
5,509,629 A * 4/1996 Sassmannshausen ..... F16M 11/16 248/169
5,739,447 A * 4/1998 Hoshino ..... G10D 13/06 248/123.2
6,220,459 B1 4/2001 Runyon
8,362,346 B1 * 1/2013 Prozinski ..... G10G 5/005 84/379
8,450,588 B2 * 5/2013 Applegate ..... G10D 7/123 84/379
9,516,400 B1 * 12/2016 Roberts ..... H04R 1/08
2007/0056430 A1 * 3/2007 Lee ..... G10G 5/005 84/395
2008/0128568 A1 6/2008 Chen
2009/0152412 A1 * 6/2009 Lorenz ..... G10G 5/00 248/165
2009/0217801 A1 9/2009 Hsieh
2011/0167986 A1 * 7/2011 Hennessey ..... G10D 13/06 84/453
2016/0027416 A1 1/2016 Hsu

OTHER PUBLICATIONS

PCT International Search Report for related application PCT/AU2017/000106 dated Jul. 17, 2017; 3 pp.
Extended European Search Report for related EP Application No. 17798376.4, dated Dec. 9, 2019; 6 pp.

* cited by examiner

STAND FOR A MUSICAL INSTRUMENT

CROSS-REFERENCE TO RELATED APPLICATION

This application is a U.S. National Phase Application of PCT/AU2017/000106, filed on May 15, 2017, which claims the benefit of Australian Provisional Application No. 2016901906 filed on May 20, 2016. Both of these applications are hereby expressly incorporated by reference in their entirety.

FIELD

The present invention relates to a stand for a musical instrument.

BACKGROUND

A musical instrument, such as a saxophone, is strapped to and supported by the neck or shoulder of a musician while it is being played. Given that the musical instrument is of a substantial weight, however, this often causes discomfort for the musician and can even lead to injury.

Although stands do exist that support musical instruments, these stands are often designed to only support a musical instrument during storage and/or lack the ergonomic adjustability needed to allow the supported musical instrument to be comfortably played. In addition, these stands are not often capable of supporting a musical instrument of various weights and sizes in a stable manner.

OBJECT OF INVENTION

It is the object of the present invention to substantially overcome or ameliorate one or more of the above disadvantages, or at least provide a useful alternative.

SUMMARY OF INVENTION

In accordance with an aspect of the present invention, there is provided a stand for a musical instrument, the stand comprising: a base; an upright having an upper end and extending upwardly from the base to the upper end; a member comprising a first end portion and a second end portion, the member being mounted on the upper end of the upright between the first end portion and the second end portion; an attachment fitting mounted on the first end portion and configured to releasably attach the musical instrument; and a counterweight mounted on the second end portion for balancing the weight of the musical instrument, wherein the second end portion is located lower than the first end portion.

Preferably, the stand further comprises an adjustment mechanism mounting the member on the upper end of the upright, the adjustment mechanism being configured to adjust a distance between the counterweight and the upright. Preferably, the adjustment mechanism comprises a body slidably engaged with the member and rotatably attached to the upper end of the upright such that the member is rotatable about an axis of the upright. Preferably, the adjustment mechanism further comprises a rod engaged with the member and screwably engaged with the body, wherein rotation of the rod about its axis slides the member relative to the body and thereby adjusts the distance between the counterweight and the upright. Preferably, the adjustment mechanism further comprises an adjustment knob mounted to an end of the rod for gripping during manual rotation of the rod.

Preferably, the second end portion is located lower than the upper end of the upright, and the first end portion is located higher than the upper end of the upright.

Preferably, the member further comprises an elongate central portion located between the first end portion and the second end portion. Preferably, the member further comprises first and second displacement portions, the second displacement portion connecting the second end portion to the central member, and the first displacement portion connecting the central portion to the first end portion. Preferably, the first displacement portion and the second displacement portion are elongate and extend parallel to each other. Preferably, the first displacement portion and the second displacement portion extend orthogonal to the central portion. Preferably, the first end portion and the second end portion are elongate and extend parallel to the elongate central portion. Preferably, the first end portion, the second end portion, the central portion, the first displacement portion, and the second displacement portion substantially extend in a plane.

Preferably, the member is integrally formed.

Preferably, the counterweight comprises an aperture in which the second end portion is received therethrough for attachment. Preferably, the stand further comprises a stopping knob screwably attached to the second end portion to limit movement of the counterweight along the member.

Preferably, the counterweight is substantially cylindrical in shape.

Preferably, the upright is telescopically extendable and retractable such that a distance between the upper end and the base is adjustable.

Preferably, the base comprises a plurality of feet for engaging with a planar floor.

In accordance with another aspect of the present invention, there is provided an assembly, comprising: a stand as described above; and a musical instrument attached to the attachment fitting of the stand.

Preferably, the musical instrument is a saxophone.

Preferably, the stand has a tension fitting that mounts the member to the upright.

Preferably, the base has at least two flexible legs forming at least two points of stability and a third point of stability provided by a lower end of the upright.

Preferably, the upright has a first upright portion, a second upright portion and a release lock, wherein the first upright portion and second upright portion are slidably engaged, and the release lock is arranged to lock the first upright portion relative to the second upright portion.

Preferably, the attachment fitting is an extendable attachment fitting.

BRIEF DESCRIPTION OF DRAWINGS

A preferred embodiment of the invention will be described hereinafter, by way of example only, with reference to the accompanying drawings, wherein.

DESCRIPTION OF EMBODIMENTS

Figure 1:
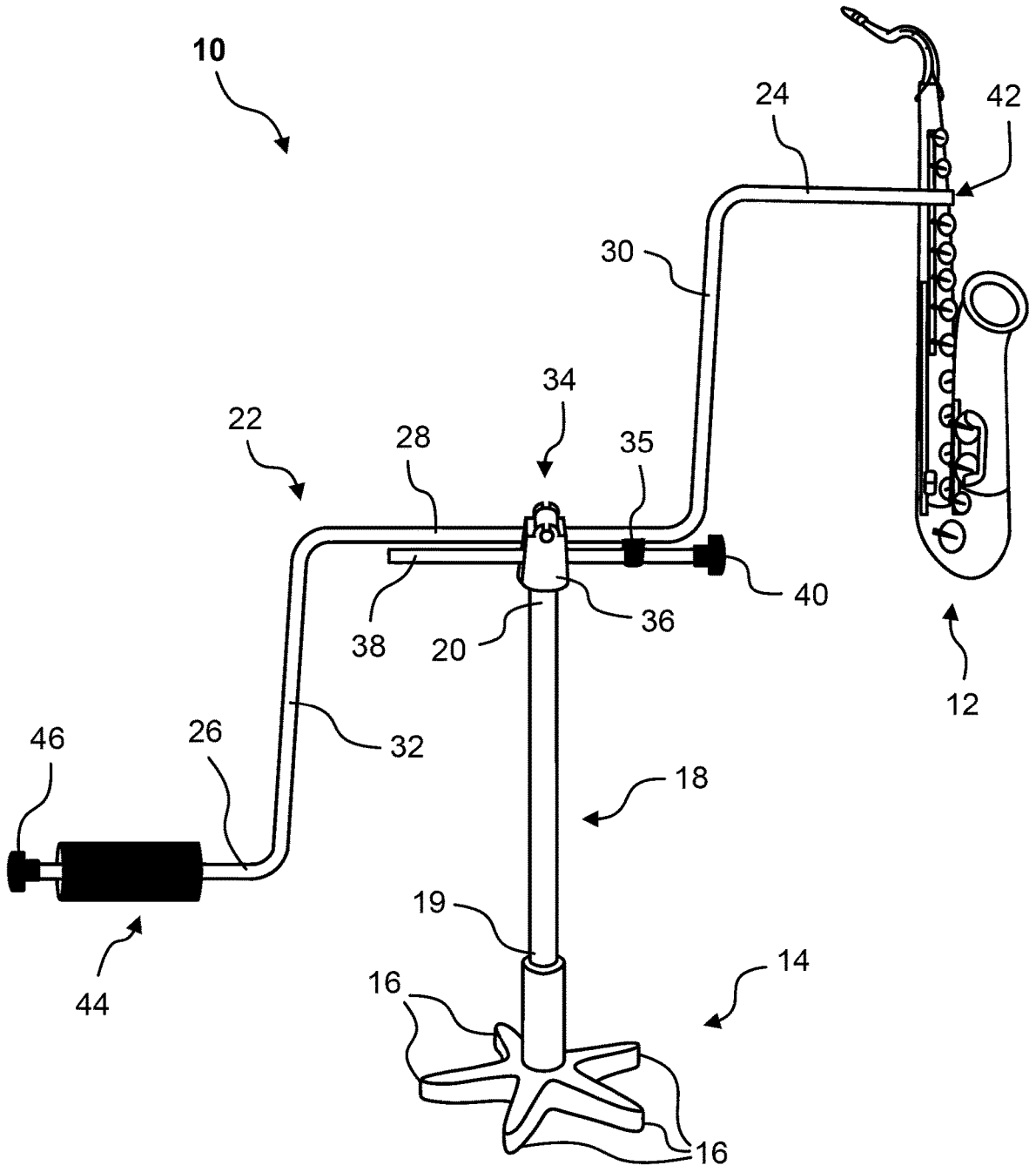
FIG. 1 shows a perspective view of an embodiment of a stand supporting a saxophone.
Figure 2:
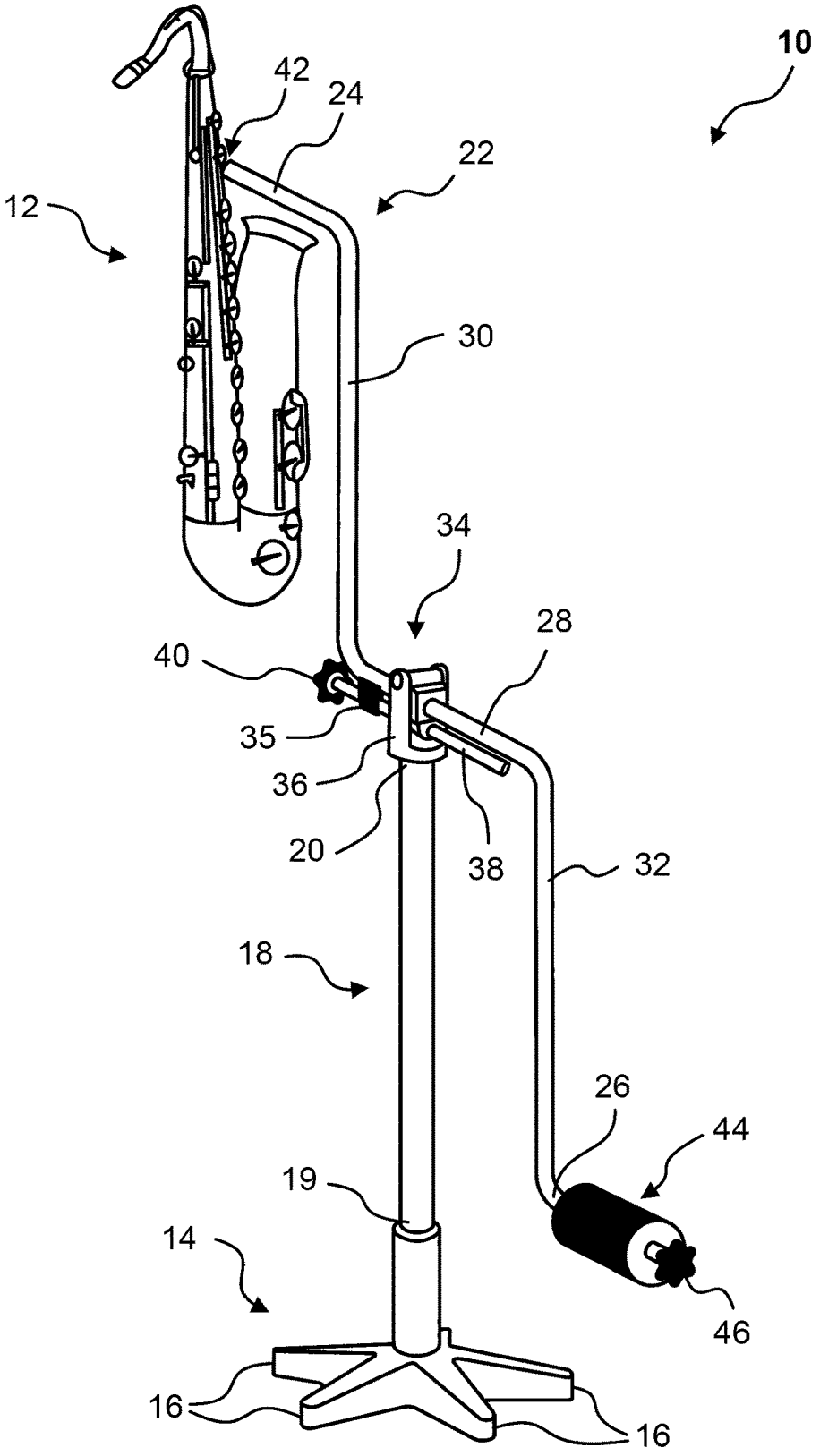
FIG. 2 shows another perspective view of the stand of FIG. 1.

FIGS. 1 and 2 of the accompanying drawings show an embodiment of a stand 10 for a musical instrument in the form of a saxophone 12. It will be appreciated that, in other embodiments, the musical instrument may be in the form of another instrument such as a bass clarinet, clarinet, bassoon, oboe or cor anglais.

The stand 10 comprises a base 14 which is configured to engage a substantially flat floor. The base 14 is formed from five feet 16 that extend radially from a centre of the base 14 to define a star-like shape. The stand 10 further comprises an upright 18 in the form of a telescopic steel pole which extends upwardly from a first end, lower end 19, attached to the centre of the base 14, to a second end, upper end 20, of the upright 18. The upright 18 is telescopically extendable and retractable such that a distance between the lower end 19 and upper end 20 can be adjusted to change the distance between the base 14 and the upper end 20.

The stand 10 further comprises a member 22 that is integrally formed from a unitary piece of steel tube. The member 22 is bent to define first and second end portions 24, 26, a central portion 28 located between the end portions 24, 26, and first and second displacement portions 30, 32 respectively connecting the end portions 24, 26 to the central portion 28. In the embodiment depicted, the end portions 24, 26 and the central portion 28 extend parallel to each other. The displacement portions 30, 32 also extend parallel to each other and extend perpendicularly to the end portions 24, 26 and the central portion 28. All of the portions 24, 26, 28, 30, 32 substantially extend in the same plane.

In alternative embodiments, the member 22 may not comprise the first displacement portion 30 or the second displacement portion 32. Instead, the first end portion 24 or the second end portion 26 may be connected directly to and axially aligned with the central portion 28.

In the embodiment depicted, the central portion 28 of the member 22 is mounted on the upper end 20 of the upright 18 by an adjustment mechanism 34 such that the second end portion 26 is located lower than the first end portion 24. Specifically, the first end portion 24 is located higher than the upper end 20 of the upright 18 and the second end portion 26 is located lower than the upper end 20 of the upright 18. The adjustment mechanism 34 comprises a plastic body 36 and an elongate threaded steel rod 38. The body 36 is rotatably attached to the upper end 20 so that it can rotate about the longitudinal axis of the upright 18. The body 36 has an aperture in which the central portion 28 of the member 22 is received therethrough so that the central portion 28 is attached to the body 36 and yet able to readily slide relative to the body 18. The body 36 further has a threaded aperture in which the rod 38 is screwably received and engaged. The adjustment mechanism 34 further comprises a plastic neck portion 35 fixed to and extending downwardly from the central portion 28. The rod 38 is rotatably attached to the neck portion 35 in such a way that the rod 38 is parallel with the central portion 28 and able to rotate about its longitudinal axis while other movements of the rod 38 relative to the central portion 28 are fixed. Accordingly, the central portion 28, and thereby the member 22, slide relative to the body 36 upon rotation of the rod 38 as it screwably engages the threaded aperture of the body 36. It will be appreciated that the sliding movement of the member 22 relative to the body 36 will adjust a distance between the second end portion 26 and the upright 18, and concurrently adjust the distance between the first end portion 24 and the upright 18.

As shown in FIGS. 1 and 2, the adjustment mechanism 34 further comprises an adjustment knob 40 mounted to a free end of the rod 38 so that it can be readily gripped for manual rotation of the rod 38.

The stand 10 further comprises an attachment fitting 42 mounted on a free end of the first end portion 24. The attachment fitting 42 is in the form of a metal spring clip hook which is configured to releasably attach the saxophone 12.

The stand 10 further comprises a steel counterweight 44 that is cylindrical in shape and has an aperture longitudinally extending therethrough. The aperture of the counterweight 44 has a diameter which is slightly larger than that of the second end portion 26 so that the second end portion 26 is received through the aperture of the counterweight 44 for mounting. The counterweight 44 is of a weight that is able to balance the weight of the saxophone 12. In the embodiment depicted, the weight of the counterweight 44 is approximately 3.9 kilograms. The stand 10 further comprises a stopping knob 46 which is larger in size than the diameter of the aperture of the counterweight 44. The stopping knob 46 is screwably attached to a free end of the second end portion 26 so that the counterweight 44 is limited in movement along the second end portion 26 and thereby prevented from sliding off the second end portion 26.

An exemplary use of the stand 10 by a musician will now be described.

The musician will transport the stand 10 to the location in which the saxophone 12 will be played. Then, the base 14 of the stand is placed on and engaged with the floor at that location such that the first and second end portions 24, 26, and the central portion 28 are substantially horizontal. It will be appreciated that the first and second displacement portions 30, 32 will therefore be substantially vertical.

The musician will then attach the saxophone 12 to the first end portion 24 by the attachment fitting 42. Given that the counterweight 44 is mounted on the second end portion 26, it will be appreciated that the member 22 will act substantially like a lever with the upper end 20 of the upright 18 acting substantially like a fulcrum. Accordingly, the counterweight 44 will counteract the weight of the saxophone 12. In the event that the counterweight 44 does not properly balance the weight of the saxophone 12 (i.e., the counterweight 44 over/under balances the weight of the saxophone 12), the musician is able to grip the adjustment knob 40 of the adjustment mechanism 34 to rotate the rod 38. This will allow the musician to adjust the distance between the counterweight 44 and the upper end 20 of upright 18, and concurrently the distance between the saxophone 12 and the upper end 20 of the upright 18. It will be appreciated that adjustments of these distances will fine tune the load moments caused by each of the saxophone 12 and the counterweight 44 so that substantial balance can be achieved. In the event that the adjustments are not able to achieve balance as the counterweight 44 is too heavy or too light, the musician is also able to detach the stopping knob 46, demount the counterweight 44 by sliding it out from the second end portion 26, and mount another counterweight with a heavier or lighter weight onto the second end portion 26.

After substantial balance has been achieved between the counterweight 44 and the weight of saxophone 12, the musician will then telescopically extend or shorten the upright 18 so that the saxophone 12 is at an appropriate height for the musician to play the saxophone 12.

According to the embodiment depicted and described above, the stand 10 allows the weight of the supported saxophone 12 to be substantially balanced by the counterweight 44 so that the stand 10 is stable. Further, the stand 10 is able to support a saxophone of various weights and sizes in a stable manner as the adjustment mechanism 34 allows for fine adjustments in the distance between the counterweight 44 and the upright 18 and/or the counterweight 44 can be interchanged for another of greater or lesser weight. Further, as the counterweight 44 is able to balance the weight of the saxophone 12, the base 14 does not have to be overly large in size and/or heavy to stably hold the saxophone 12. Further, as the second end portion 26 is located lower than the first end portion 24, the stand 10 is not top heavy and therefore is more stable. This also positions the counterweight 44 at a non-hazardous height and allows it to be readily interchanged with another counterweight as the distance from the floor is not substantial. Further, as the upright 18 is telescopically extendable, the saxophone 12 can be ergonomically played by the musician.

It will be appreciated, as the adjustment mechanism 34 allows for fine adjustments in the distance between the counterweight 44 and the upright 18 and/or the counterweight 44 can be interchanged for another of greater or less weight, additional attachments may be added to the first end portion 24 with the saxophone 12 and still be potentially balanced by the counterweight 44. For example, a microphone, a music head stand and/or mouthpiece cap stand may be attached to the first end portion 24.

A further embodiment of the stand for a musical instrument is now described with reference to FIGS. 3 to 15.

According to this embodiment, the stand 301 has a base 302 that is provided in the form of two legs (303A and 303B) and a lower end 305 of an upright 307. The two legs (303A and 303B) and lower end 305 provide three points of stability upon which the stand sits. The legs are made out of a flexible plastic material and provide a degree of flexibility to enable the upright 307 of the stand to move as the legs flex. It will be understood that more than two legs may be provided.

As in the embodiment described with reference to FIGS. 1 and 2, the upright extends upwards from the base towards a member 309 and attaches to the member 309. In this embodiment, the upright attaches to the member via a tension fitting 311. The upright 307 in this embodiment is formed from a first upright portion 307A and a second upright portion 307B. The first upright portion 307A has a smaller diameter that the second upright portion 307B. The first upright portion 307A and a second upright portion 307B are connected together via a release lock 313. When in an unlocked mode, the release lock enables the first upright portion 307A to slidably engage with the second upright portion 307B and enter into the cavity of the second upright portion 307B to adjust the overall length of the upright (i.e. the combined length of first upright portion 307A and the exposed length of second upright portion 307B). When in a locked mode, the release lock engages with the outer surface of the second upright portion 307B to lock the position of the second upright portion 307B relative to the first upright portion 307A.

The tension fitting 311 engages with the member 309 to secure the member in position. The tension fitting 311 has a tension spring fitted therein to enable the member 309 to move relative to the upright 307 (and in particular, relative to the second upright portion 307B). The relative movement provided by the tension spring in the tension fitting provides more flexibility of movement of the member, and increased flexibility overall for the stand when the tension fitting movement is combined with the movement provided by the flexible legs (303A and 303B). Further, by having a tension spring formed within the tension fitting 311 less counterbalance forces are required and so the distance between the counterweight 314 and the attachment fitting may be reduced and so the total length of the member in this embodiment may be less than the length of the member described with reference to FIGS. 1 and 2. Also, by having the tension spring formed within the attachment fitting 311 less counterbalance forces are required and so the weight of the counterweight 314 may be reduced. For example, in this embodiment, the counterweight component, which is made from two components, may weigh approximately 2 kg in total. This is less than the approximate 3.9 kg of the counterweight in the first embodiment due to the increased resistance created by the tension spring.

In this embodiment, an attachment fitting 315 extends from a first end portion of the member 309. This attachment fitting is used to releasably attach the musical instrument to the stand. For example, the attachment fitting may include a releasable hook 317 to engage with the musical instrument. The attachment fitting 315 is extendably engaged with an internal portion of the member 309 to allow the user to extend the attachment fitting from the member so that the musical instrument is not required to be positioned directly next to the first end portion of the member. For example, the attachment fitting 315 may include a steel cable 319 that is attached to an anchor point (not shown) within the cavity of the member via a spring to enable the cable to be extended out of the member and also retracted depending on the user's preferences.

In accordance with this embodiment, the upright and member may be made out of any suitable material, such as, for example, carbon fibre or aluminium with a powder coating.

Figure 5A:
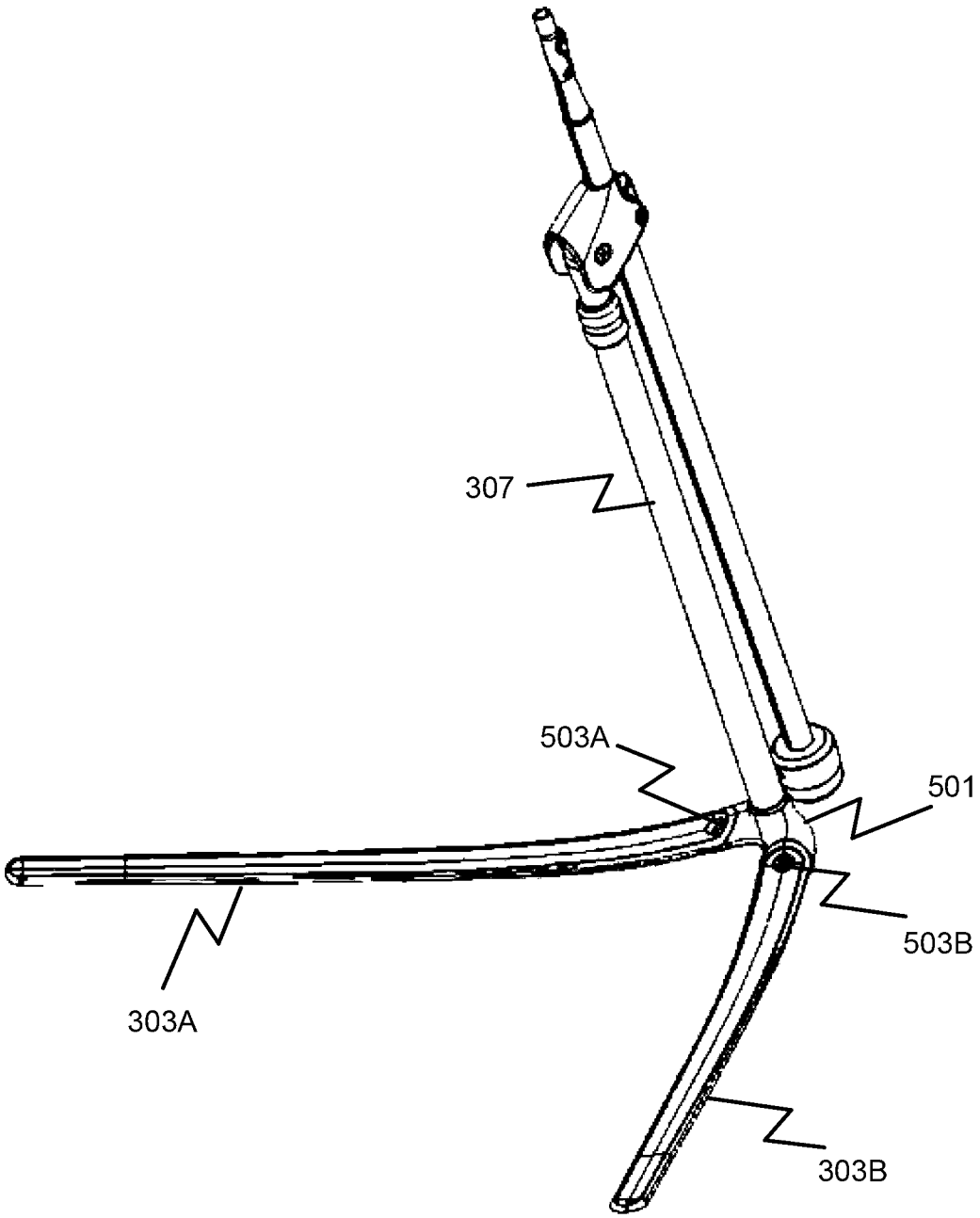
FIGS. 5A and 5B show the collapsible legs of the stand in FIG. 3 in an extended and collapsed configuration.
Figure 5B:
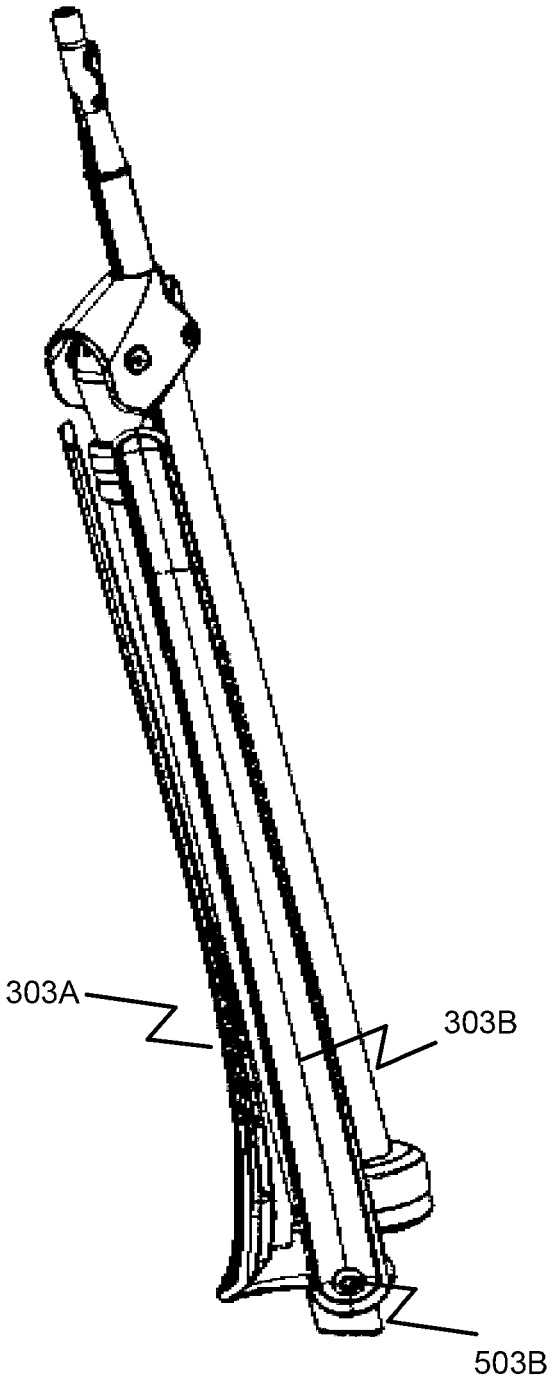

FIGS. 5A and 5B show the collapsible legs (303A & 303B) of the stand 301. FIG. 5A shows the legs in an extended configuration, while FIG. 5B shows the legs in a collapsed configuration. A leg connecting portion 501 connects the legs to the upright 307. Each leg (303A & 303B) is rotatable about a rotatable connection point (503A & 503B), as shown in more detail in FIGS. 6A to 6C.

The legs have a flat profile where the thickness of each leg increases from the tip to the point of connection to the upright. This reduces the risk of the user tripping over the legs when in use. For example, the thinnest part of the leg may be around 5-6 mm. In the extended configuration, the legs protrude at an angle of approximately 60 degrees relative to the upright.

Figure 6A:
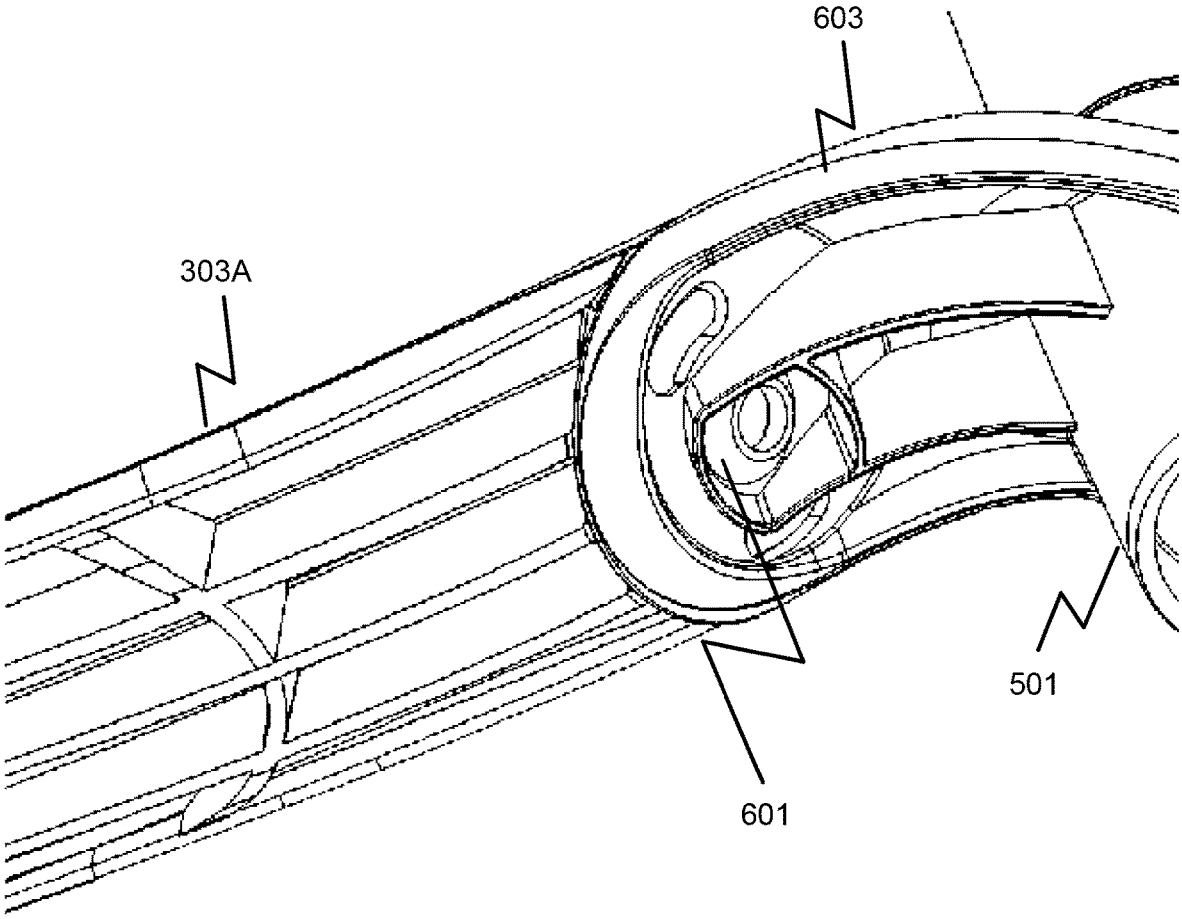
FIGS. 6A to 6C show details of the rotatable and locking functionality of the legs for the stand shown in FIG. 3.
Figure 6B:
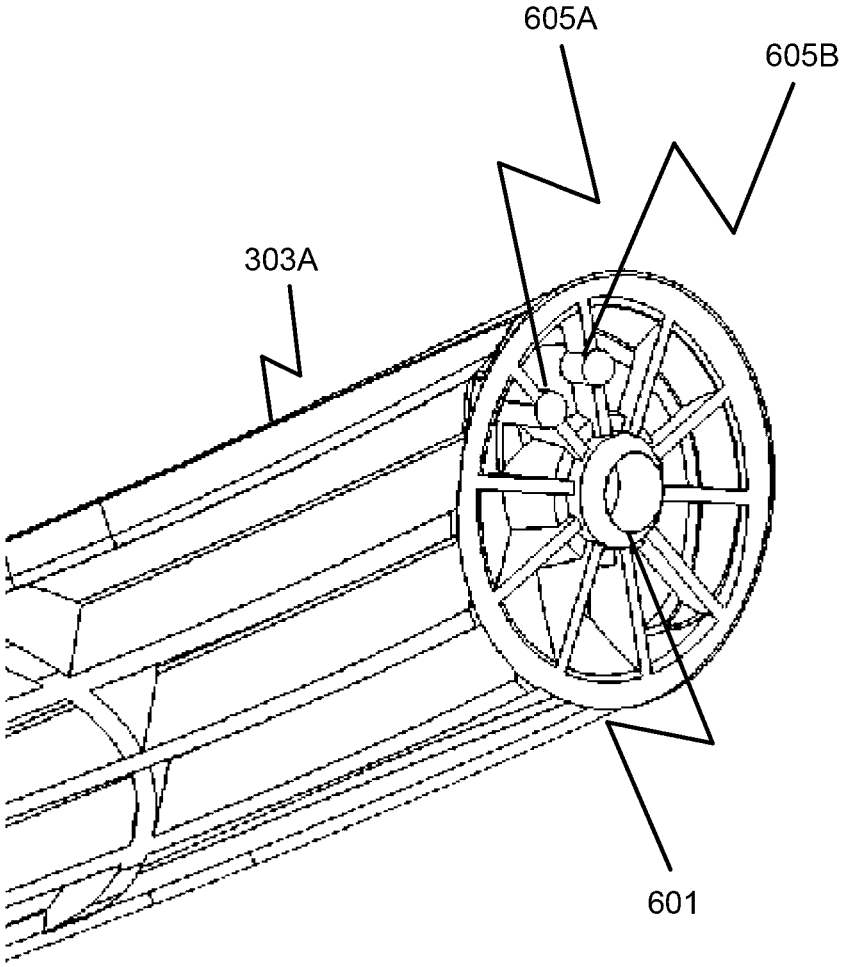
Figure 6C:
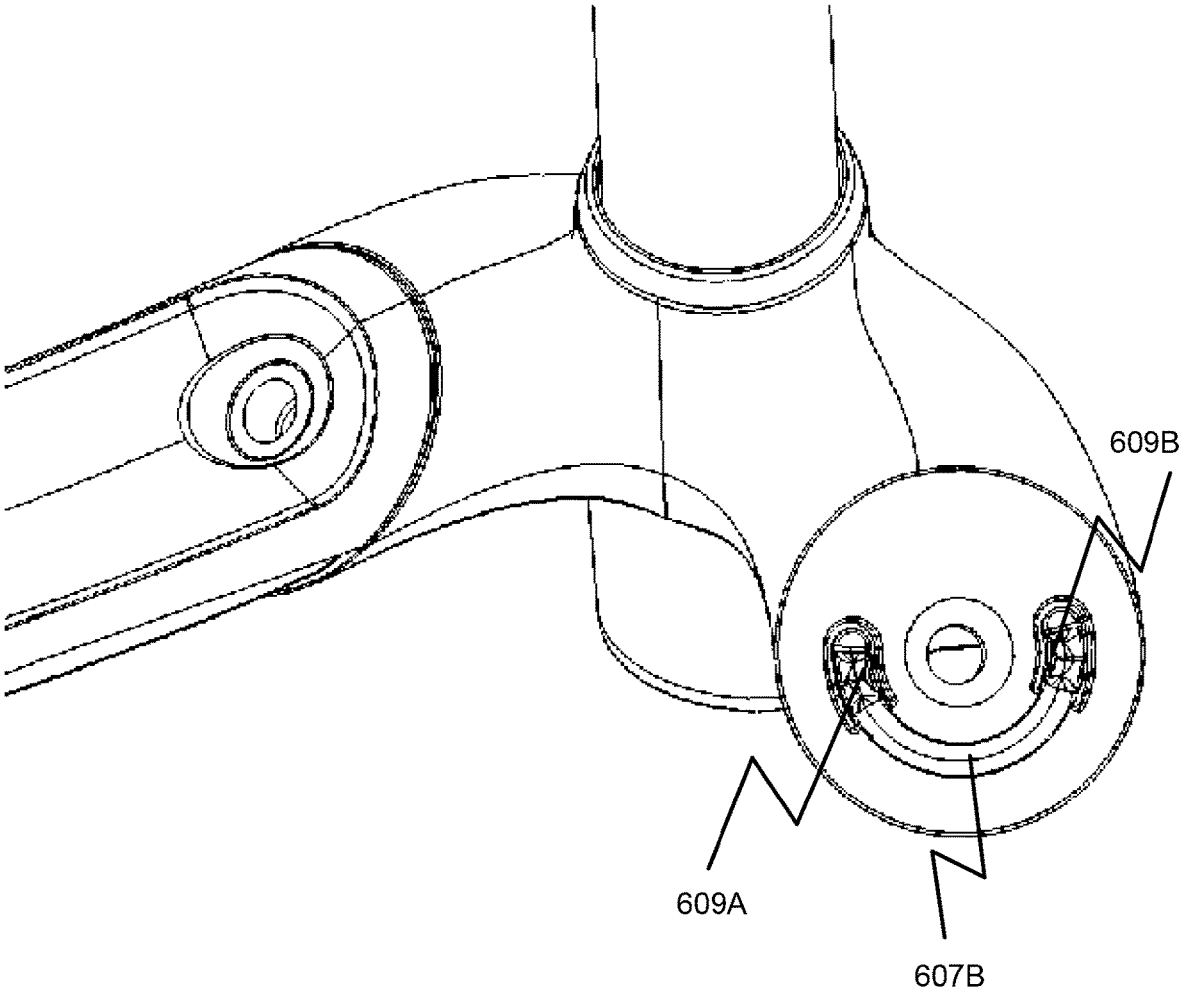

FIGS. 6A to 6C show details of the rotatable connection between the legs (303A & 303B) and the leg connecting portion 501. FIG. 6A shows an underside view of leg 303A connecting to the leg connecting portion 501. A leg insert 601 fits through and engages with a corresponding hole (see FIG. 6C) located in an extended portion 603 of the leg connecting portion 501 to lock the leg to the leg connecting portion. This creates the rotatable connection point 503A that enables the leg to rotate relative to the leg connecting portion.

FIG. 6B shows the underside of the leg 303A when not connected to the leg connecting portion 501. The leg insert 601 is shown as a round protrusion extending from a central point at the distal end of the leg 303A. Two locating nodes (605A & 605B) extend from the distal end of the leg 303A. These locating modes are arranged to locate into a corresponding slot in the leg connecting portion 501 (see FIG. 6C).

FIG. 6C shows the leg connecting portion 501 with the leg 303B removed to show the slot 607B that is arranged to receive the locating nodes that are equivalent to locating nodes 605A and 605B that extend from leg 303B.

The curved slot 607B includes projections (609A & 609B) in the channel of the slot to disrupt the movement of the locating nodes and cause the leg to lock into position when the locating nodes reach either end of the slot 607B. It will be understood that each side of the leg connecting portion has equivalent projections for locking each of the legs in each of the extended and collapsed configuration.

Figure 7A:
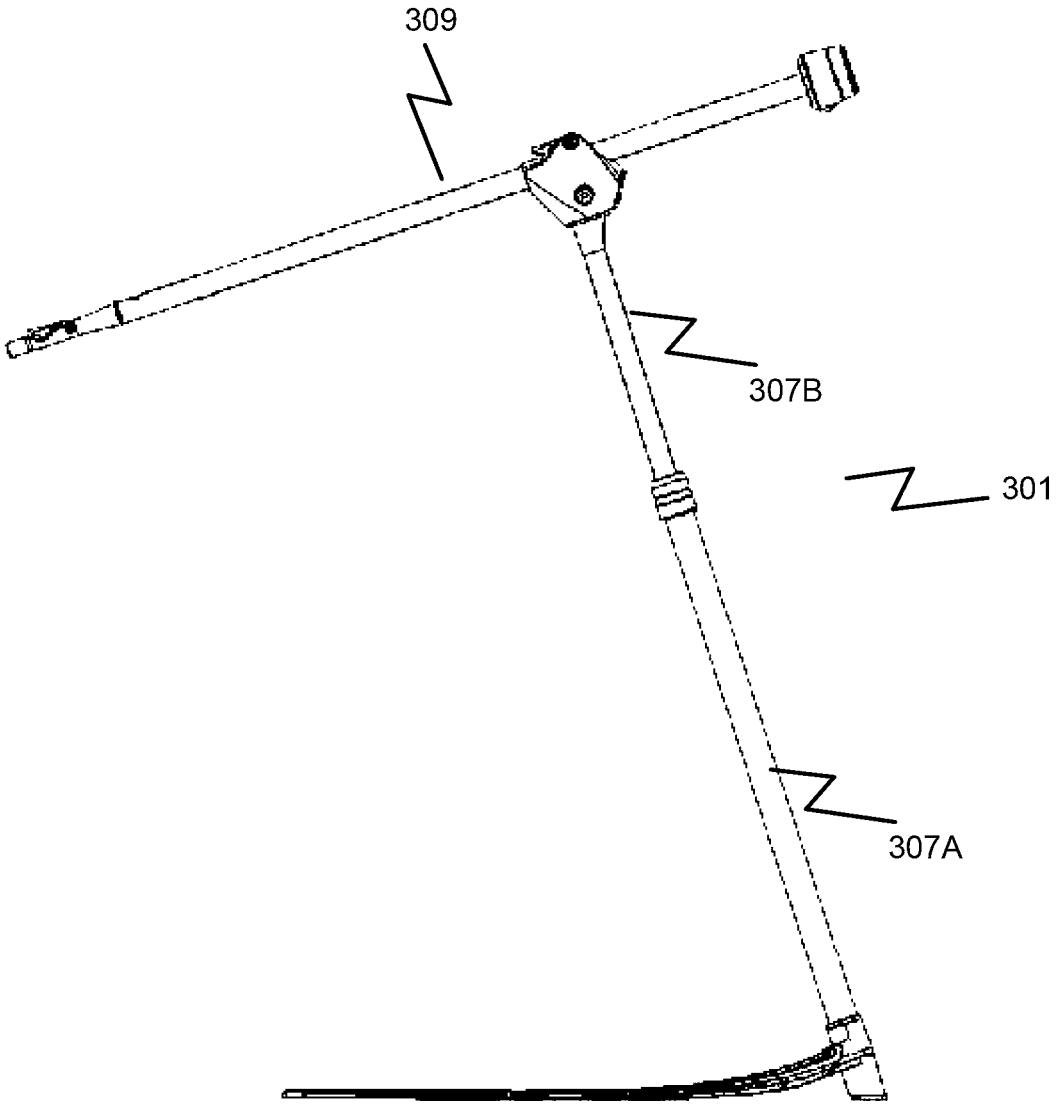
FIGS. 7A and 7B show the stand of FIG. 3 in two different usable configurations.
Figure 7B:
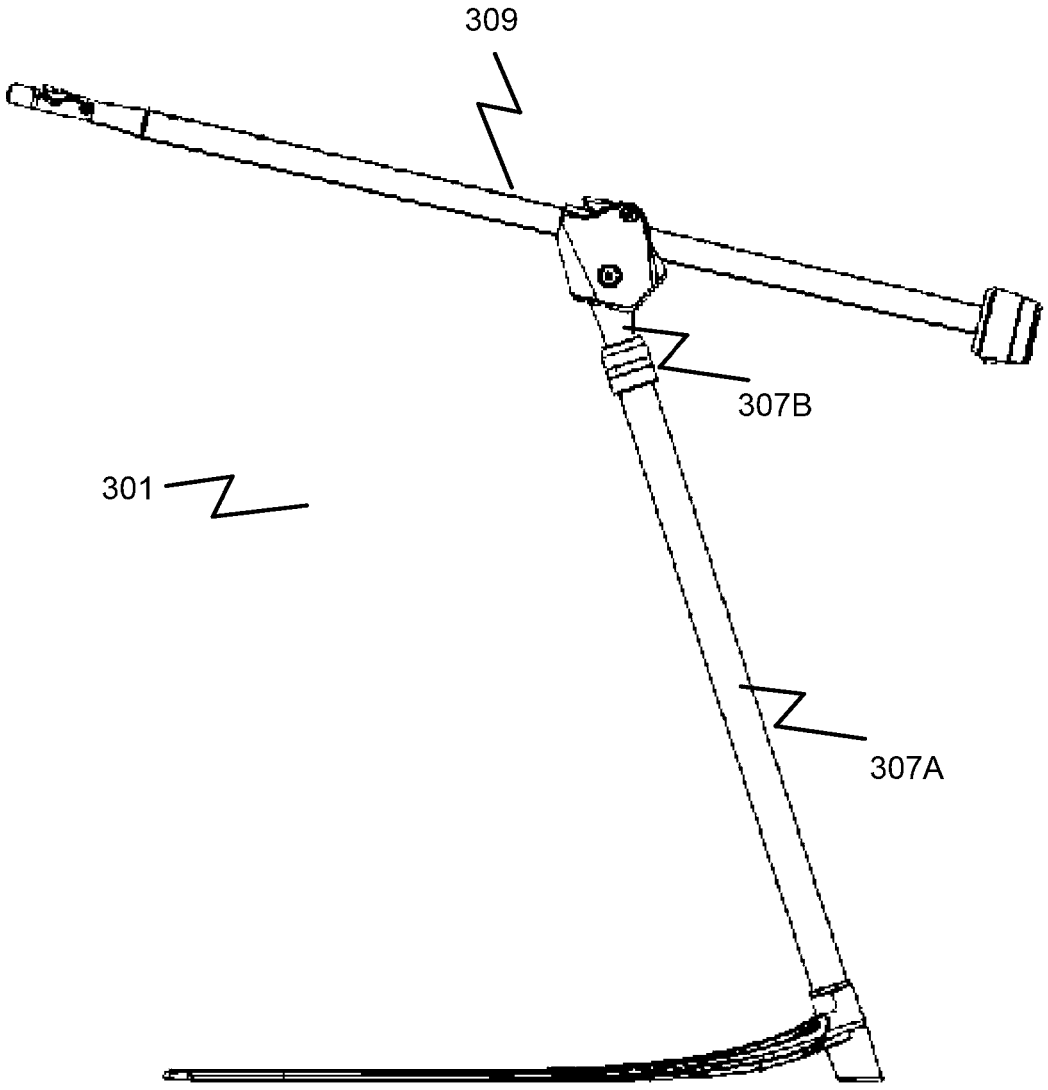

FIGS. 7A and 7B show the stand 301 in two different usable configurations. In FIG. 7A, the stand 301 is shown in a configuration for use by a user when seated where the second upright portion 307B is extended out of the first upright portion 307A. In this configuration, the first end portion of the member 309 is lower than the counterweight 314. In FIG. 7B, the stand 301 is shown in a configuration for use by a user when standing where the second upright portion 307B is not extending out of the first upright portion 307A. In this configuration, the first end portion of the member 309 is higher than the counterweight 314.

Figure 8:
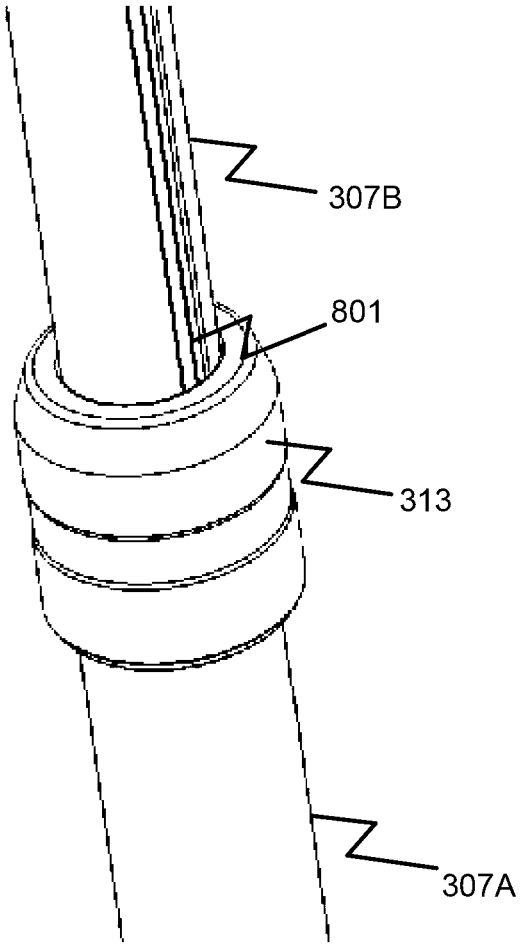
FIG. 8 shows a keying groove in an upright portion of the stand in FIG. 3.

FIG. 8 shows the release lock 313 located between the first upright portion 307A and the second upright portion 307B. Inside the release lock is a restricting thread on the tightening collar that, when adjusted, tightens against the second upright portion 307B to lock it into position relative to the first upright portion 307A.

FIG. 8 also shows a keying groove 801 located along the outer surface of the second upright portion 307B. The groove 801 runs parallel to the axis of the second upright portion 307B. This groove is arranged to interact with a protrusion (see 1001 in FIG. 10) within the tension fitting 311 to stop the second upright portion from rotating relative to the tension fitting 311. The location of the keying groove in the second upright portion is such that it is central to the user when the stand is in use. That is, the groove is positioned centrally between the two legs.

Figure 9:
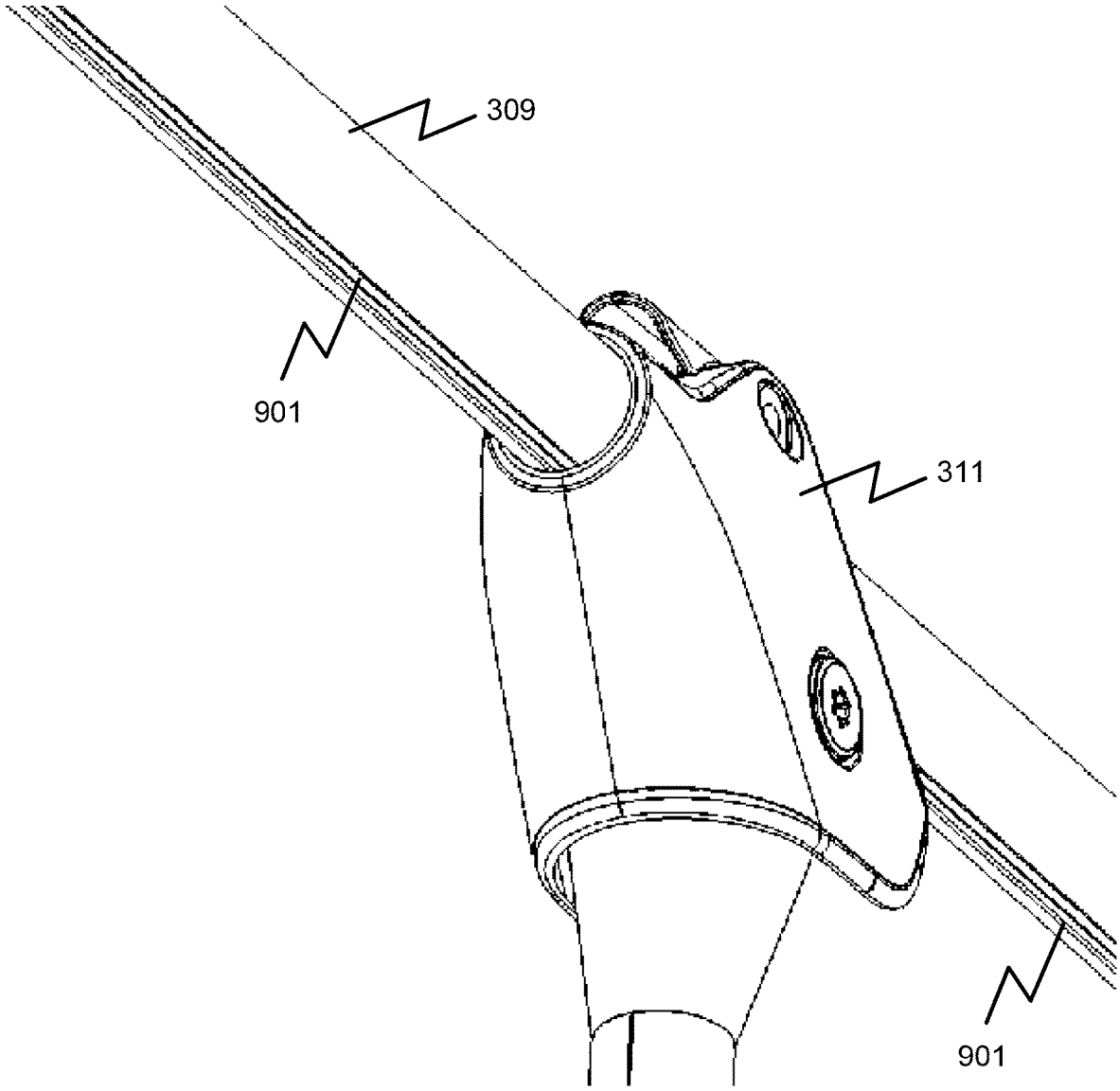
FIGS. 9 and 10 show a keying groove in a cross member of the stand shown in FIG. 3.
Figure 10:
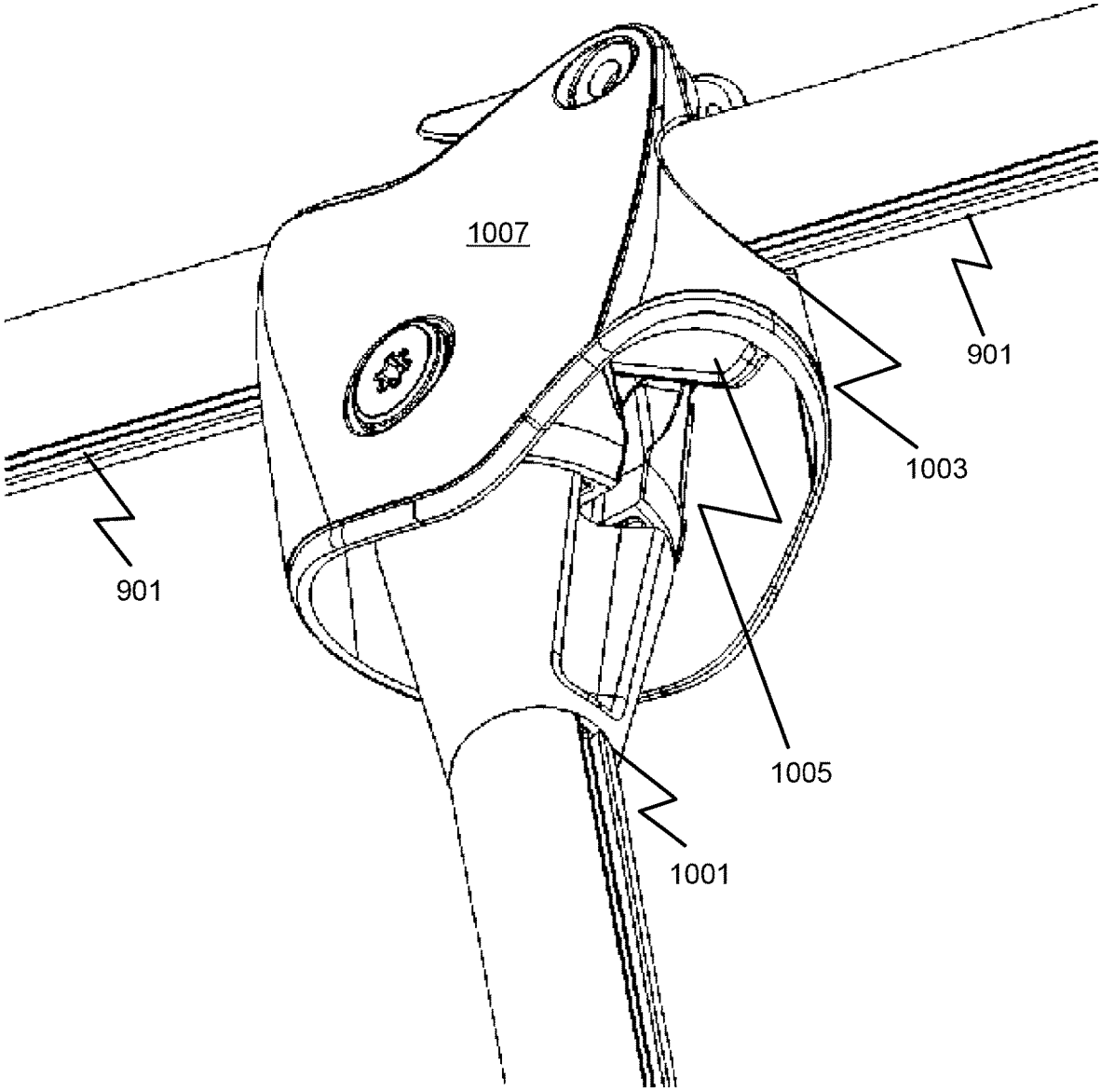

FIGS. 9 and 10 show a keying groove 901 located along the outer surface of the member 309. The groove 901 runs parallel to the axis of the member 309. This groove is arranged to interact with a protrusion 1003 (FIG. 10) located within the tension fitting 311 to stop the member from rotating relative to the tension fitting 311.

Regarding FIGS. 10 and 11, a self-centering feature is provided by the interaction of a v-shaped grove 1101 formed in a lower portion 1103 of the tension fitting 311 and a locating portion 1005 (FIG. 10) formed in an upper portion 1007 of the tension fitting 311. This self-centering feature causes the member to centre itself between the two legs when pressure is not applied.

Figure 11A:
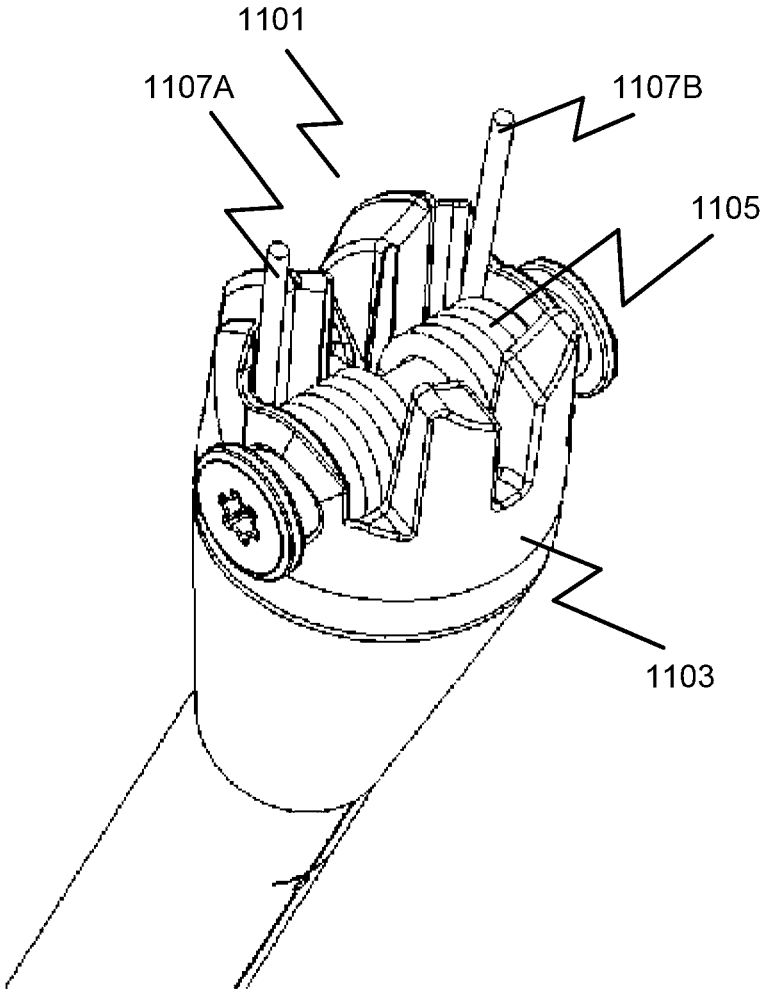
FIGS. 11A and 11B show details of a tension fitting of the stand in FIG. 3.
Figure 11B:
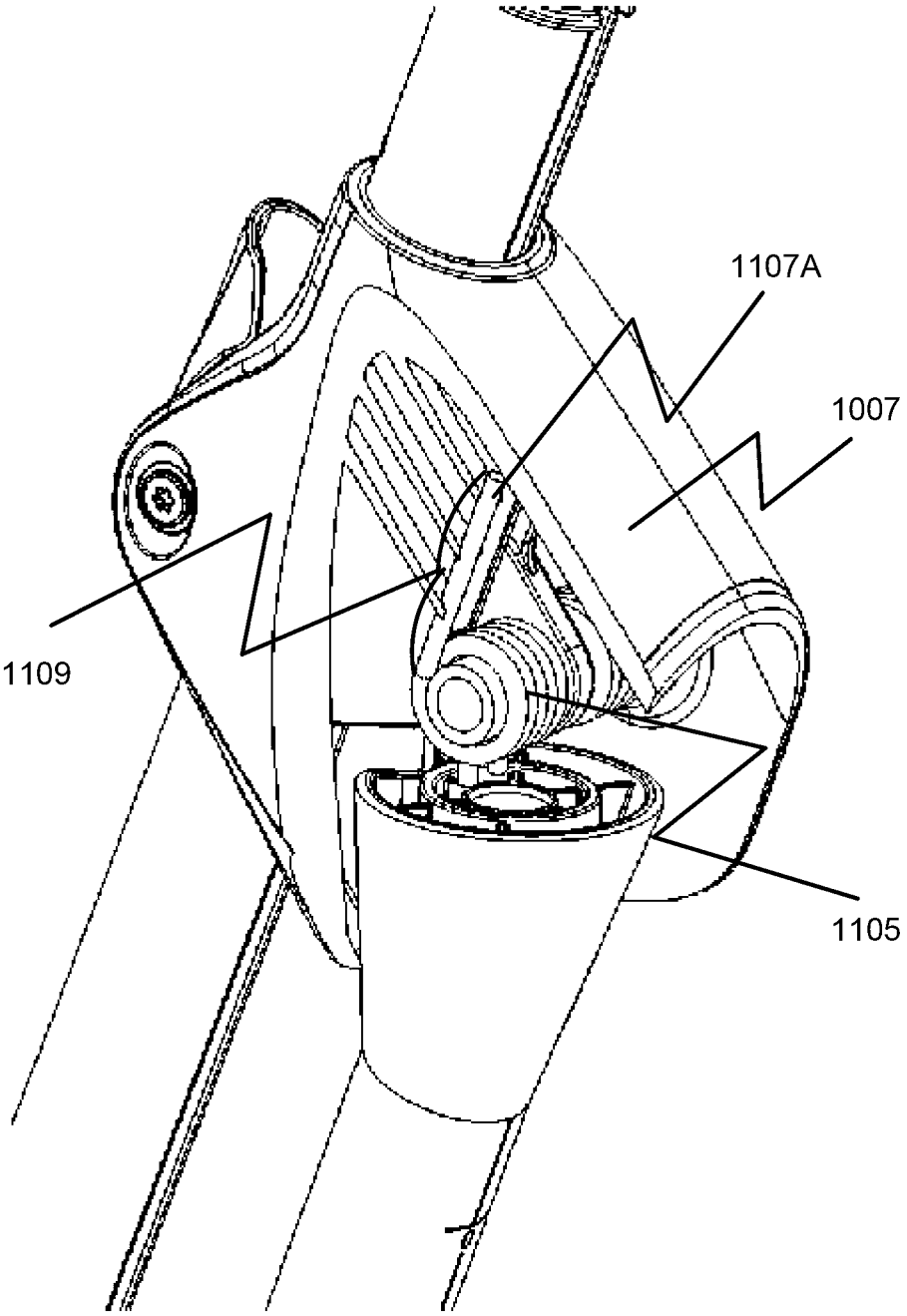

FIGS. 11A and 11B show more details of the internal workings of the tension fitting 311 including the tension spring 1105 which locates in a recess 1107 of the lower portion 1103 of the tension fitting 311 (FIG. 11A). The two ends (1107A & 1107B) of the tension spring engage against a respective surface 1109 formed on the upper portion 1007 of the tension fitting 311 (FIG. 11B). It will be understood that the lower portion 1103 of the tension fitting 311 is not shown in FIG. 11B to more clearly show the tension spring interacting with the surface 1109 formed on the upper portion 1007.

Figure 12A:
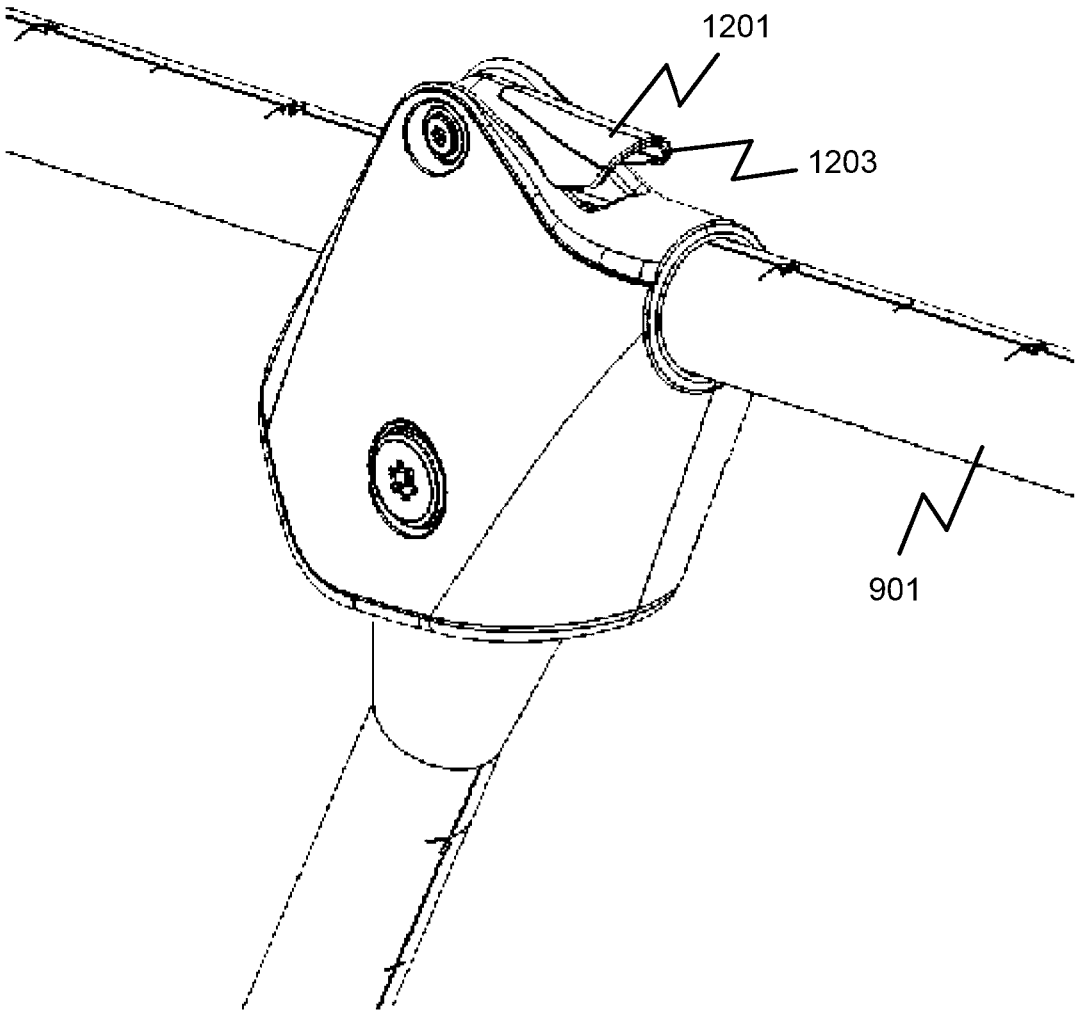
FIGS. 12A and 12B show a cam lever system used with the stand shown in FIG. 3.
Figure 12B:
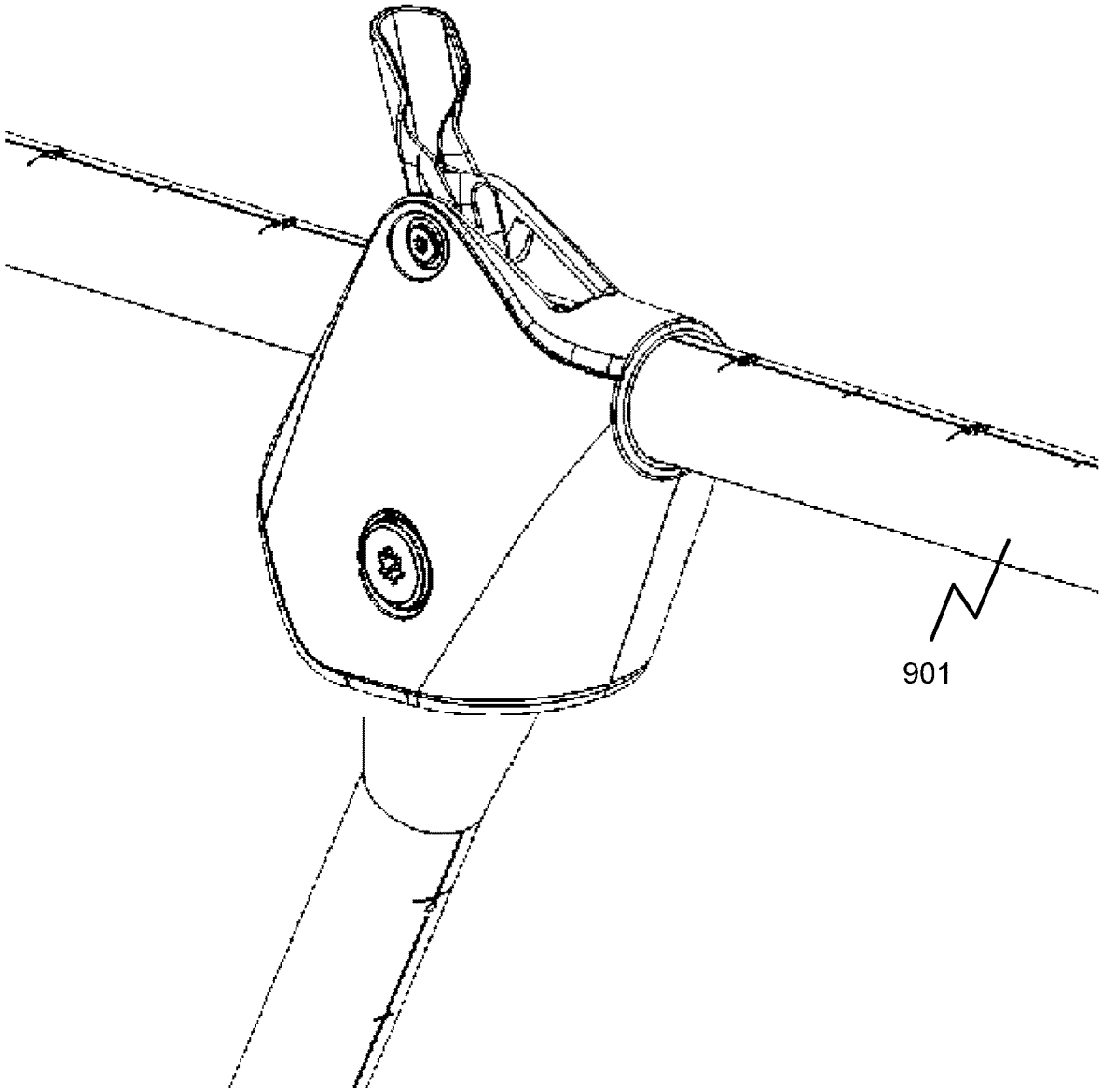

FIGS. 12A and 12B provide views of a cam lever operation in a respective locked and unlocked mode. In the locked mode (FIG. 12A), the cam lever 1201 is directed towards a down position such that the operating lever portion 1203 lies parallel to the axis of the member 901. In the unlocked mode (FIG. 12B), the cam lever 1201 is directed towards an up position such that the operating lever portion 1203 lies perpendicular to the axis of the member 901. In the locked mode, a surface 1205 of the cam lever 1201 engages with a surface of the member 901 to lock the member in position relative to the central tension fitting through which the member 901 is located. When moved to the locked mode, the surface 1205 of the cam lever 1201 does not engage with the surface 1207 of the member 901, and so the member is not locked in position relative to the central tension fitting through which the member 901 is located.

Figure 13:
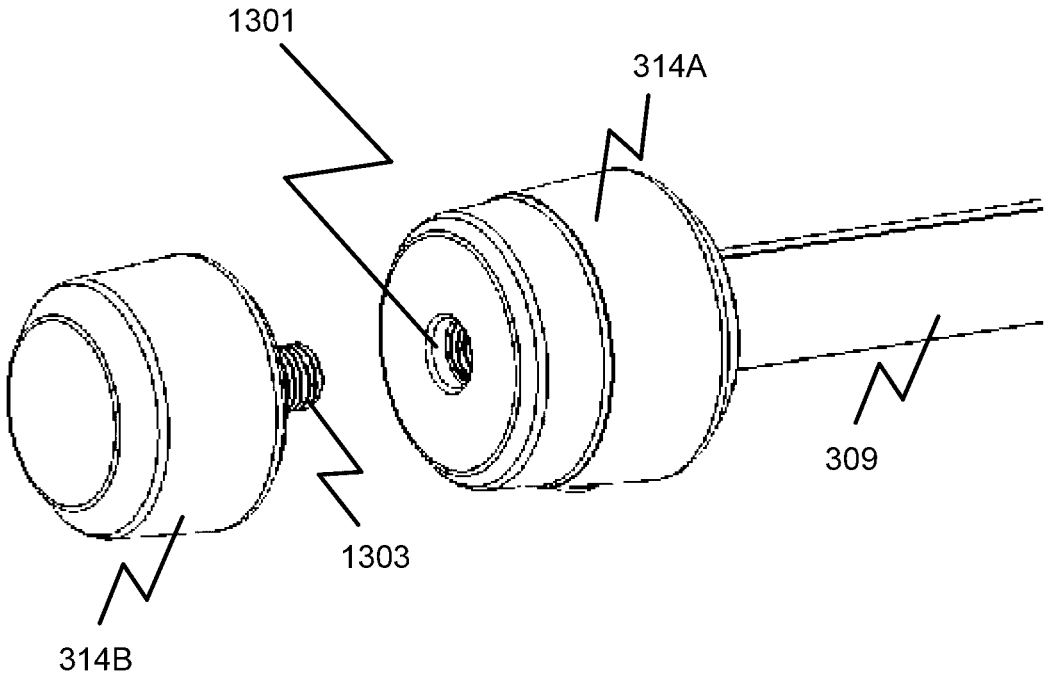
FIG. 13 shows the multi-part counterweight system used in accordance with the stand shown in FIG. 3.

FIG. 13 shows the multi-part counterweight system used in accordance with the stand 301. The counterweight 314 includes two counterweight components (314A & 314B). The first counterweight component 314A is attached to the distal end of the member 309 on a first side and on a second side has a threaded aperture 1301 located centrally on the body of the component 314A. The second counterweight component 314B includes a threaded screw component 1303 located centrally on the body of the component 1303 that corresponds with the threaded aperture 1301. The threaded screw component 1303 may be screwed into the threaded aperture 1301 to connect the two counterweight components together. This enables the total weight of the counterweight to be easily adjusted depending on the musical instrument being used with the stand. It will be understood that the counterbalance may be formed from two or more counterbalance components, where each of the components engage with each other to form a complete counterbalance.

Figure 14:
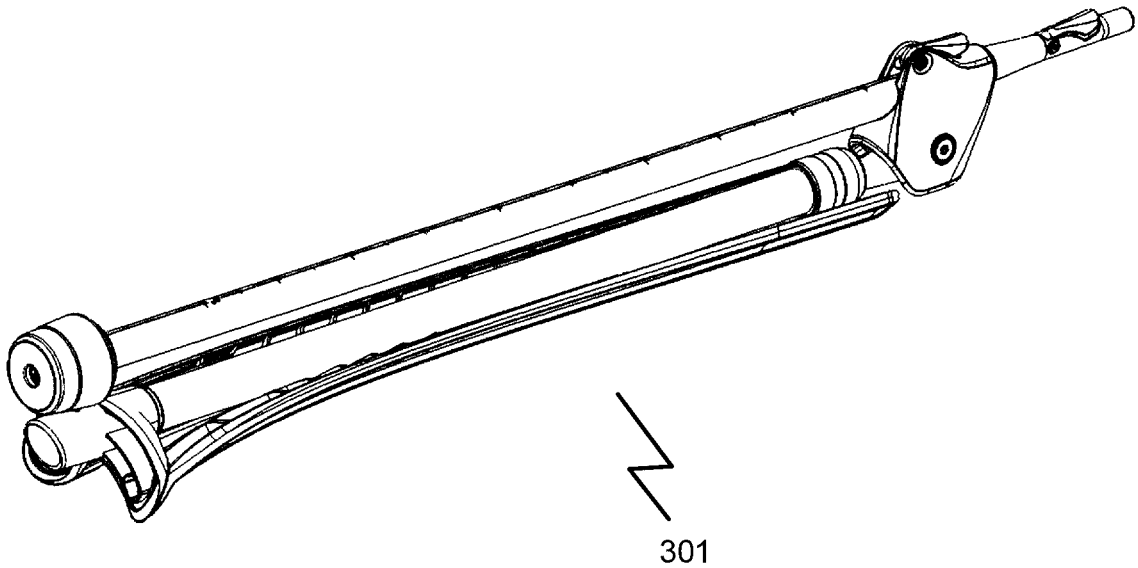
FIG. 14 shows the stand of FIG. 3 in a compact configuration suitable for storing and packaging.

FIG. 14 shows the stand 301 in a compact configuration suitable for storing and packaging.

Figure 3:
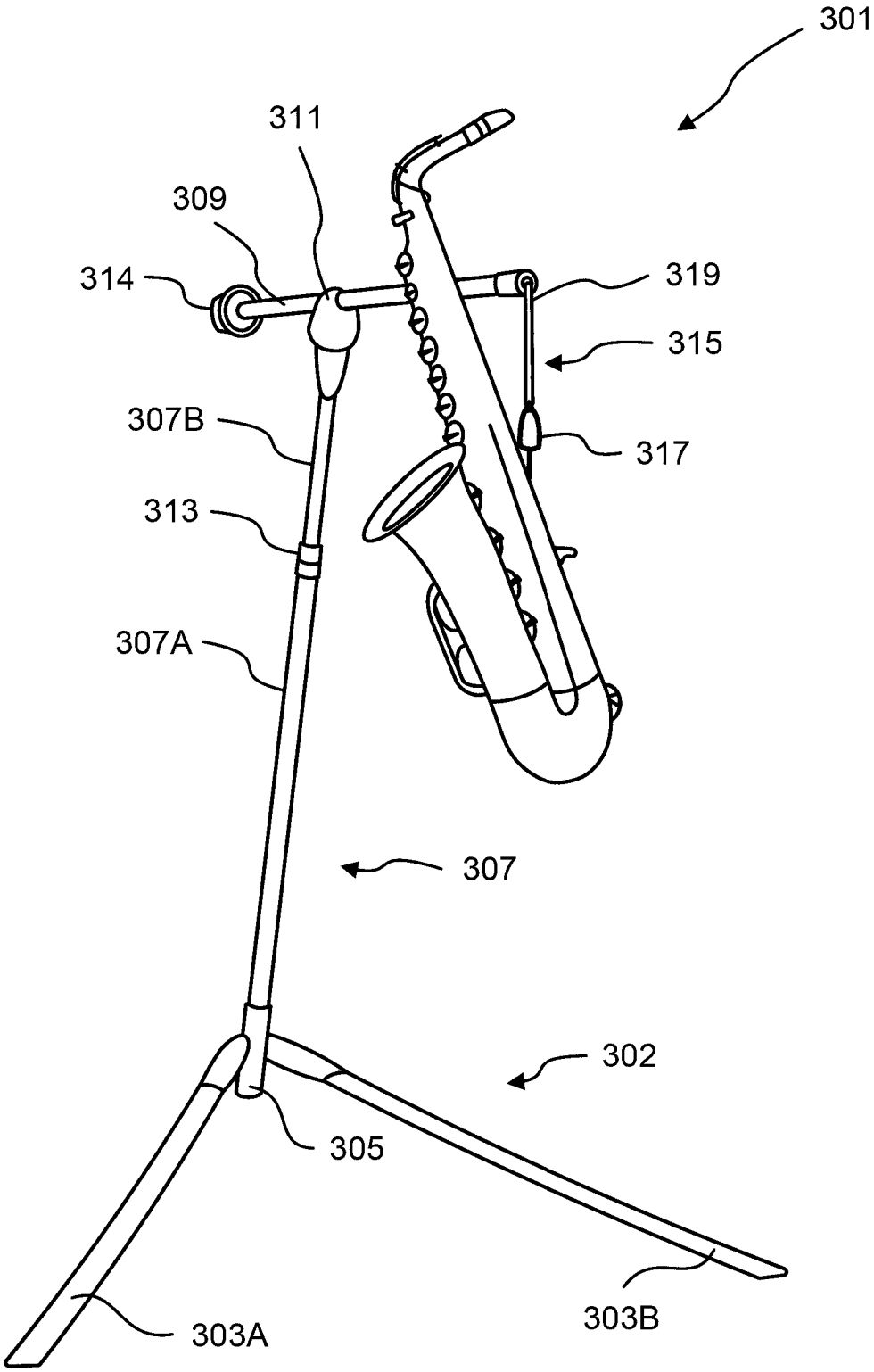
FIG. 3 shows a further embodiment of a stand supporting a saxophone.
Figure 4:
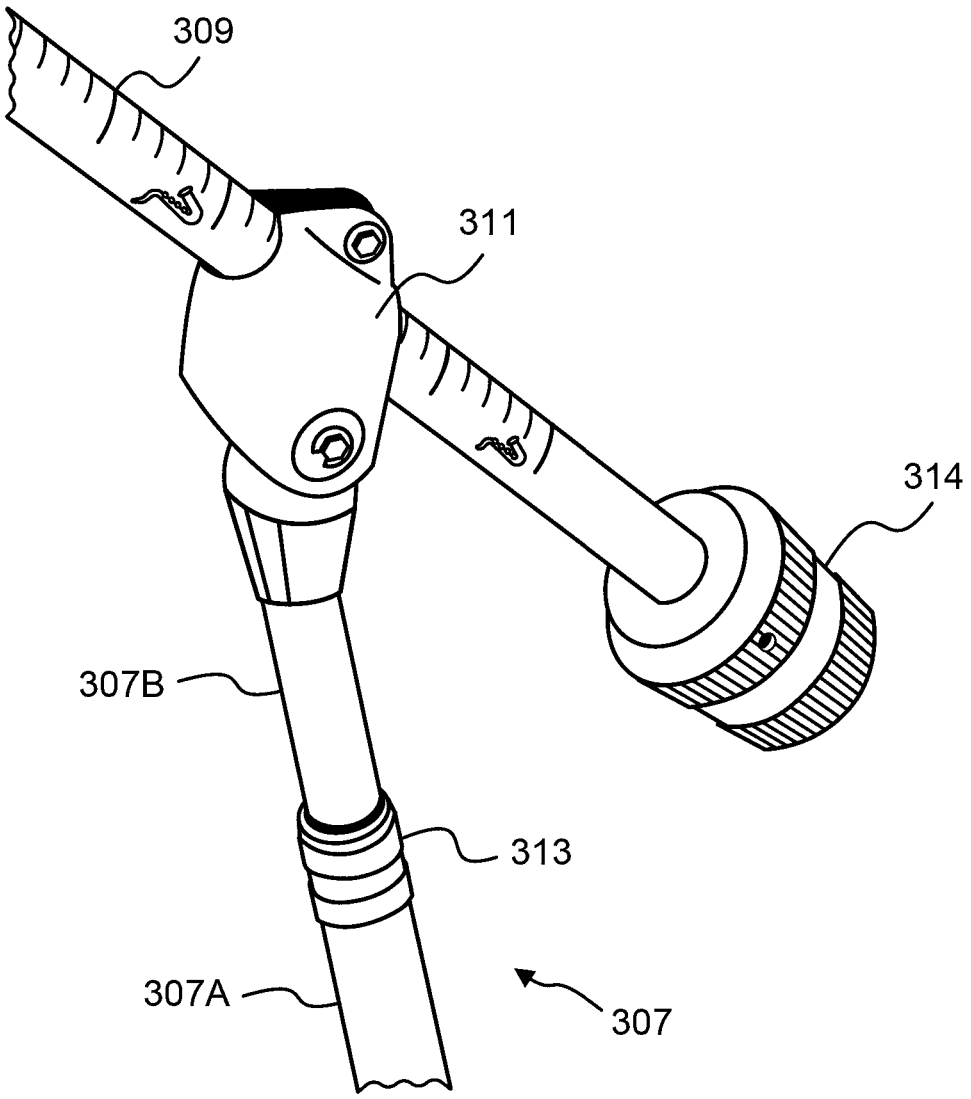
FIG. 4 shows detail of a tension fitting of the stand shown in FIG. 3.
Figure 15:
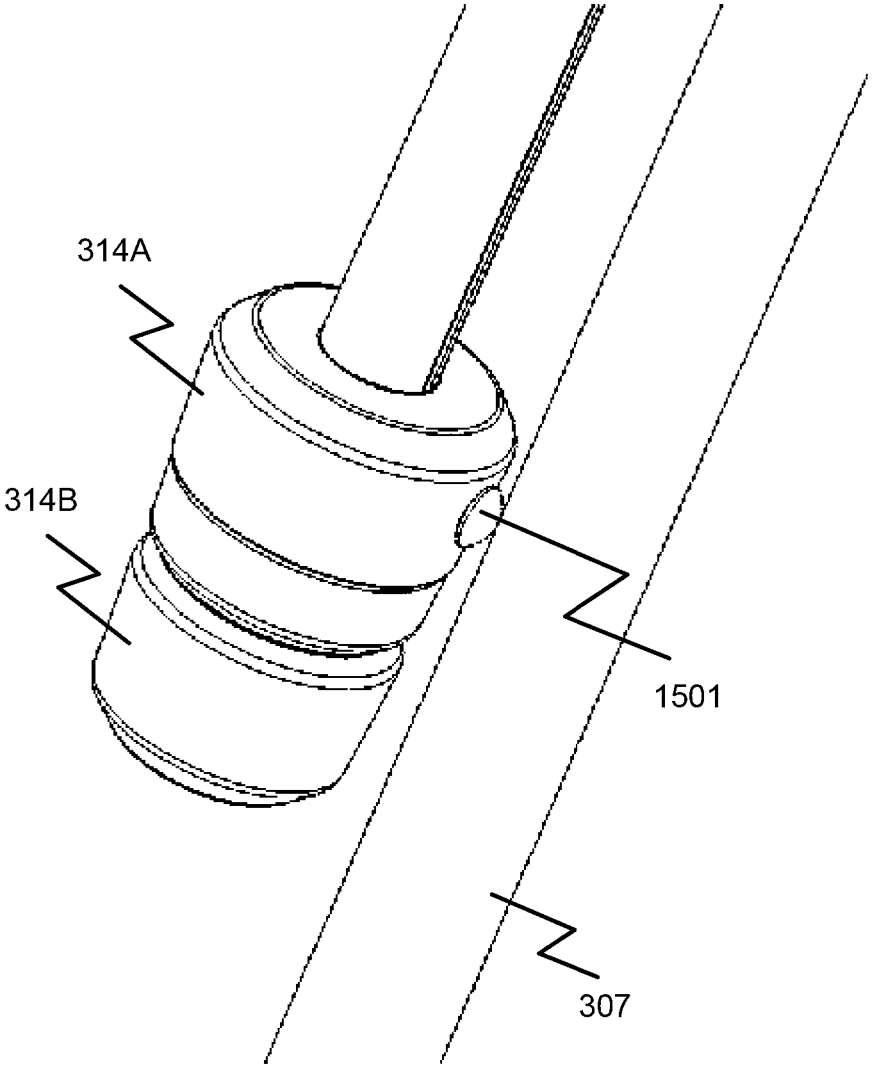
FIG. 15 shows detail of a counterbalance for the stand of FIG. 3.

FIG. 15 shows details of a counterbalance for the stand of FIG. 3 when the stand 301 is in a compact configuration. A dome headed rubber bung 1501 is located within an aperture formed in the first counterweight component 314A. The rubber bung 1501 rests up against the upright 307 when in the compact configuration and stops the metal of the counterbalance component scratching the upright 307.

Although the invention has been described with reference to a preferred embodiment, it will be appreciated by a person skilled in the art that the invention may be embodied in many other forms.

The invention claimed is:

1. A stand for a musical instrument, the stand comprising:
a base;
an upright having an upper end and extending upwardly from the base to the upper end;
a member comprising a first end portion and a second end portion, the member being mounted on the upper end of the upright between the first end portion and the second end portion;
an attachment fitting mounted on the first end portion and configured to releasably attach the musical instrument;
a counterweight mounted on the second end portion for balancing the weight of the musical instrument; and
an adjustment mechanism mounting the member on the upper end of the upright, the adjustment mechanism being configured to adjust a distance between the counterweight and the upright, wherein the adjustment mechanism comprises:
a body slidably engaged with the member and rotatably attached to the upper end of the upright such that the member is rotatable about an axis of the upright; and
a rod engaged with the member and screwably engaged with the body, wherein rotation of the rod about its axis slides the member relative to the body and thereby adjusts the distance between the counterweight and the upright.

2. The stand according to claim 1, wherein the adjustment mechanism further comprises an adjustment knob mounted to an end of the rod for gripping during manual rotation of the rod.

3. The stand according to claim 1, wherein the second end portion is located lower than the upper end of the upright, and the first end portion is located higher than the upper end of the upright.

4. The stand according to claim 1, wherein the member further comprises an elongate central portion located between the first end portion and the second end portion.

5. The stand according to claim 4, wherein the member further comprises first and second displacement portions, the second displacement portion connecting the second end portion to the central member, and the first displacement portion connecting the central portion to the first end portion.

6. The stand according to claim 5, wherein the first displacement portion and the second displacement portion are elongate and extend parallel to each other.

7. The stand according to claim 5, wherein the first displacement portion and the second displacement portion extend orthogonal to the central portion.

8. The stand according to claim 4, wherein the first end portion and the second end portion are elongate and extend parallel to the elongate central portion.

9. The stand according to claim 5, wherein the first end portion, the second end portion, the central portion, the first displacement portion, and the second displacement portion substantially extend in a plane.

10. The stand according to claim 1, wherein the member is integrally formed.

11. The stand according to claim 1, wherein the counterweight comprises an aperture in which the second end portion is received therethrough for attachment.

12. The stand according to claim 11, further comprising a stopping knob screwably attached to the second end portion to limit movement of the counterweight along the member.

13. The stand according to claim 1, wherein the counterweight is substantially cylindrical in shape.

14. The stand according to claim 1, wherein the upright is telescopically extendable and retractable such that a distance between the upper end and the base is adjustable.

15. The stand according to claim 1, wherein the base comprises a plurality of feet for engaging with a planar floor.

16. The stand according to claim 1 further comprising a tension fitting that mounts the member to the upright.

17. The stand according to claim 1, wherein the base further comprises at least two flexible legs forming at least two points of stability and a third point of stability provided by a lower end of the upright.

18. The stand according to claim 1 wherein the upright comprises a first upright portion, a second upright portion and a release lock, wherein the first upright portion and second upright portion are slidably engaged, and the release lock is arranged to lock the first upright portion relative to the second upright portion.

19. The stand according to claim 1, wherein the attachment fitting is an extendable attachment fitting.

20. The stand according to claim 1, wherein the legs are rotatable to move between an extended configuration and a collapsible configuration.

21. The stand of claim 20 wherein the legs are arranged to lock in each of the extended configuration and collapsible configuration.

22. The stand according to claim 1, wherein the counterbalance is formed from two or more counterbalance components that engage with each other.

23. An assembly, comprising:
the stand according to claim 1; and
a musical instrument attached to the attachment fitting of the stand.

24. The assembly according to claim 23, wherein the musical instrument is a saxophone.

* * * * *